US011852455B2

(12) United States Patent
Kruger et al.

(10) Patent No.: US 11,852,455 B2
(45) Date of Patent: Dec. 26, 2023

(54) LIGHT SENSITIVE ARRANGEMENT FOR A DETONATOR

(71) Applicant: DETNET SOUTH AFRICA (PTY) LTD, Johannesburg (ZA)

(72) Inventors: Michiel Jacobus Kruger, Johannesburg (ZA); Daniel Auguste Maurissens, Orbe (CH); Albertus Abraham Labuschagne, Brakpan (ZA); Andre Louis Koekemoer, Boksburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 242 days.

(21) Appl. No.: 17/422,251

(22) PCT Filed: Jan. 27, 2020

(86) PCT No.: PCT/ZA2020/050013
§ 371 (c)(1),
(2) Date: Jul. 12, 2021

(87) PCT Pub. No.: WO2020/160579
PCT Pub. Date: Aug. 6, 2020

(65) Prior Publication Data

US 2022/0090900 A1 Mar. 24, 2022

(30) Foreign Application Priority Data

Jan. 28, 2019 (ZA) ..... 2019/00556

(51) Int. Cl.
*F42D 1/05* (2006.01)

(52) U.S. Cl.
CPC ..... *F42D 1/05* (2013.01)

(58) Field of Classification Search
CPC ..... F42D 1/05
USPC ..... 102/206
See application file for complete search history.

(56) References Cited

U.S. PATENT DOCUMENTS

2012/0012019 A1 1/2012 Harding et al.
2018/0119530 A1 5/2018 Skinner et al.

FOREIGN PATENT DOCUMENTS

FR 3050815 A1 11/2017
WO 2011044593 A1 4/2011

OTHER PUBLICATIONS

International Preliminary Report on Patentability for PCT/ZA2020/050013, international filing date of Jan. 27, 2020, date of completion May 10, 2021, 9 pages.
International Search Report for PCT/ZA2020/050013, international filing date of Jan. 27, 2020, dated May 18, 2020, 4 pages.
Written Opinion for PCT/ZA2020/050013, international filing date of Jan. 27, 2020, dated May 18, 2020, 6 pages.

*Primary Examiner* — Samir Abdosh
(74) *Attorney, Agent, or Firm* — CANTOR COLBURN LLP

(57) ABSTRACT

A detonator which is used with a shock tube or a fibre optic cable and wherein an incident light signal is passed through a first impedance for communication purposes and a light signal associated with initiation of the detonator is passed through a second impedance which is less in value than the first impedance.

5 Claims, 1 Drawing Sheet

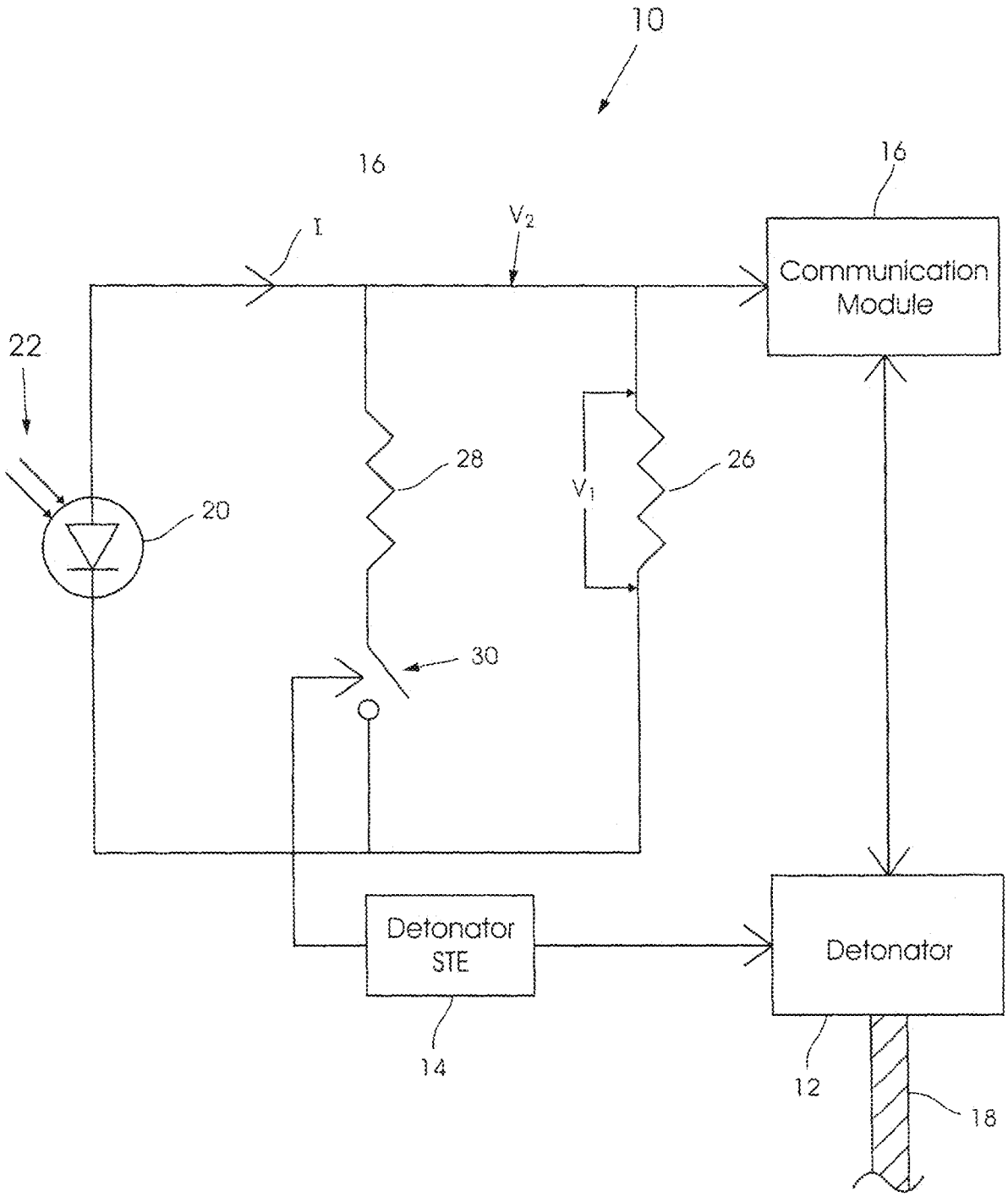
10
16
16
I
$V_2$
Communication Module
22
28
26
$V_1$
20
30
Detonator STE
Detonator
14
12
18

LIGHT SENSITIVE ARRANGEMENT FOR A DETONATOR

CROSS-REFERENCE TO RELATED APPLICATIONS

This application is a U.S. national stage application of International Application No. PCT/ZA2020/050013 entitled "LIGHT SENSITIVE ARRANGEMENT FOR A DETONATOR", which has an international filing date of 27 Jan. 2020, and which claims priority to South African Patent Application No. 2019/00556, filed 28 Jan. 2019.

BACKGROUND OF THE INVENTION

This invention relates to a light sensitive arrangement for a detonator which is used with an elongate conductor such as a fibre optic cable or a shock tube.

A detonator of the aforementioned kind, based on the use of a shock tube, is described for example in the specification of U.S. Pat. No. 8,967,048. Triggering of the detonator happens in response to a shock tube event. The shock tube event includes plasma and light and is accompanied by a temperature rise and a pressure wave. One or more of these characteristics are identified as being uniquely associated with a shock tube event and, upon such verification, a process which leads to initiation of the detonator is executed. Light of at least a particular intensity is one such characteristic which is uniquely associated with the shock tube event.

If a fibre optic cable connected to a detonator is used for communication purposes, and to initiate the detonator, then the characteristic of importance is light.

In each approach (shock tube or fibre optic cable) the presence of light, at a defined location of the detonator, is sensed by means of an appropriate sensor, for example a photovoltaic cell. Communication with the detonator can also be carried out using the light detecting capabilities of the photovoltaic cell. It is desirable for a number of reasons to use the same photovoltaic cell for detecting the light which acts as a trigger event to fire the detonator and for detecting light which is used for communication purposes.

A photovoltaic cell exposed to light produces an electric current the amplitude of which is dependent on the intensity of the light which is incident on the cell. As the light intensity increases so does the current, until a saturation level is reached. This limits the amplitude of the current which can be produced by the cell. This means that the sensor can only measure the light level over a certain range effectively before the saturation level is reached. This works against the use of a single sensor in the manner proposed in that that sensor should be capable of detecting two distinct light levels. It is to be noted that the light produced by a shock tube event endures for a relatively long but non-predictable time period but, during that period, it is for a short time interval that the light level is sufficiently high to be qualified, accurately, as coming from a genuine shock tube event. In a fibre optic application the situation is similar in that the requirement for the sensor to be responsive reliably to two different light levels remains.

Typically in a fibre optic application a light signal is transmitted from a laser through the fibre optic cable. A low intensive light signal is used for communication purposes and a high intensity light signal is used as a trigger signal. Thus the conductor may be categorised as being "light transmissive".

In a shock tube application a fibre optic cable can be included in the shock tube and that cable is then used for communication purposes. However firing of a detonator to which the shock tube is connected is in response to a shock tube event which, in the current instance, is light which is uniquely associated with the shock tube event. In this respect the conductor can be referred to as "light generating".

An object of the present invention is to allow for a single light sensor to be used for detecting a firing signal and for communication purposes.

SUMMARY OF THE INVENTION

The invention provides a light sensitive arrangement for a detonator which is used with an elongate light transmissive or light generating conductor, the arrangement including a light sensor which produces an output current in response to an incident first light signal, a first impedance through which the output current is directed to provide a signal indicating that the first light signal is being used for communication purposes, a second impedance connected in series with a switch which is closed in response to detection of a second light signal which is associated with initiation of the detonator so that the output current is then directed at least through the second impedance, and wherein the first impedance is higher in value than the second impedance.

During communication the first light signal incident on the light sensor has a low energy content and the output current is correspondingly low. To achieve a high voltage drop over the first impedance, the first impedance thus has a high value.

For initiation of the detonator the light intensity of the second light signal is high and the output current is correspondingly high. In order to produce an acceptable signal across the second impedance the value of the second impedance is lower than the value of the first impedance.

The second impedance and the switch are preferably connected in parallel with the first impedance. Although the first impedance has a high value the value of the two impedances presented to the output current is nonetheless low due to the closure of the switch which places the low value second impedance in parallel with the high value first impedance.

If the conductor is a shock tube the second light signal is indicative of a shock tube event. If a firing signal is transmitted to the detonator via a fibre optic cable, e.g. from a laser, then the laser is used to produce a distinct (different) high energy content/high intensity light signal.

BRIEF DESCRIPTION OF THE DRAWING

The invention is further described by way of example with reference to the accompanying drawing which illustrates a light sensitive arrangement for a detonator according to the invention.

DESCRIPTION OF PREFERRED EMBODIMENT

The following description relates initially to the application of the invention to a light sensitive arrangement for a detonator which is used with a shock tube.

The accompanying drawing illustrates a light sensitive arrangement 10 for a detonator 12 which includes a detector 14 for detecting a designated shock tube event (STE) and a communication module 16 which works at a light frequency.

In general terms the detonator 12 is of the kind described for example in the specification of U.S. Pat. No. 8,967,048.

Thus a further description of constructional details of the detonator and its manner of working is not included in this specification.

The detonator 12 is, as is explained in the a foregoing US patent specification, connected to a shock tube 18 and, upon initiation of the shock tube, an event is generated which, once uniquely verified, is used to initiate the detonator. Communication with the detonator is effected at a light frequency via the communication module 16.

It is desirable to make use of a single light sensor for functioning in response to a shock tube event and for communication purposes. For the latter case the shock tube may embody a fibre optic cable which is included for the purpose. The arrangement 10 thus includes a single photovoltaic cell 20 which is positioned so it is responsive to incident light 22. That light can arise from a communication signal or from a shock tube event. The photovoltaic cell 20 produces an output current I the amplitude of which is dependent on the intensity of the light 22 which is incident on the cell 20. The relationship of the incident light intensity to the output current I is however not linear for, due to physical factors, saturation of the cell occurs as the light intensity increases.

To enable the cell 20 to function at the relatively low light amplitude levels associated with communication signals, a first impedance 26 is connected across the cell 20. This impedance has a high value so that a low level current flowing through the impedance 26 produces a relatively high voltage $V_1$, across the impedance 26, which is output to the communication module 16.

The arrangement 10 includes a second impedance 28 which is connected in series with a switch 30 which is operated by means of a signal from the shock tube event detector 14. The impedance 28 has a low value compared to the value of the impedance 26.

If a shock tube event occurs then the intensity of the light 22 in the shock tube event which is incident on the photovoltaic cell 20 is substantially increased. The shock tube event is also detected by the detector 14 which causes closure of the switch 30. This connects the second impedance 28 in parallel with the first impedance 26 and the output current of the photovoltaic cell 20 flows through the two impedances.

The impedance 28 is of a significantly lower value than the first impedance 26 and the combined value of the two impedances, which are in parallel, is slightly lower than the value of the impedance 28. Thus a high current flows through the parallel impedances which have a low combined impedance value, and an output voltage $V_2$ is produced.

Thus for communication purposes a high impedance circuit, i.e. the impedance 26 is used to generate a voltage $V_1$ which arises due to the communication light source and which is used to trigger the communication module 16.

Upon detection of a shock tube event by the detector 14 the significantly lower impedance 28 is connected across the photovoltaic cell 20 in parallel with the impedance 26. The voltage $V_2$ which is generated is limited. Effectively the photovoltaic cell 20 is desensitized during the shock tube event. This voltage $V_2$ is used to verify the presence of the high intensity light 22 associated with a genuine shock tube event.

The arrangement 10 makes it possible for the original sensitivity level of the cell 20 to be restored after some time, which may be of a programmable duration. This can allow for sensitive light measurements to take place for communication or other purposes.

The preceding description relates to a detonator which is responsive to a shock tube event. As indicated it is possible to replace the shock tube which is connected to the detonator with a fibre optic cable. A communication signal generated at a control point by a laser can be transmitted via the fibre optic cable to the detonator. This is for communication purposes. When the detonator is to be fired a high intensity light signal is transmitted via the fibre optic cable from a laser to the detonator. In the fibre optic application the light sensitive arrangement of the invention which makes use of a single sensor is responsive reliably to a low intensity communication light signal and to a high intensity light signal used for triggering the detonator.

The invention claimed is:

1. A detonator which in use is connected to an elongate light transmissive or light generating conductor, the detonator including a communication module and a light sensitive arrangement, wherein the light sensitive arrangement includes a detector, a light sensor, a first impedance, a second impedance, and a switch, which is connected in series with the second impedance, wherein the light sensor, in response to an incident first light signal produces an output current which is directed through the first impedance to produce a voltage which is output to the communication module, and wherein the detector is configured to detect a second light signal which is associated with initiation of the detonator and which, upon detection of the second light signal, causes the switch to be closed so that the output current of the light sensor is directed at least through the second impedance to produce a second voltage signal, and wherein the first impedance is higher in value than the second impedance.

2. A detonator according to claim 1 wherein the light intensity of the second light signal is higher than the light intensity of the first light signal.

3. A detonator according to claim 1 wherein the second impedance and the switch are connected in parallel with the first impedance.

4. A detonator according to claim 1 wherein the conductor is a shock tube and the second light signal is produced by a shock tube event.

5. A detonator according to claim 1 wherein the conductor is a fibre optic cable and the second light signal is produced by a laser.

* * * * *